US005524967A

United States Patent [19]

Glöckl

[11] Patent Number: 5,524,967

[45] Date of Patent: Jun. 11, 1996

[54] ACTIVE DYNAMIC SEAT

[76] Inventor: Josef Glöckl, Ammerseestrasse 6, D-8011 Kirchheim, Germany

[21] Appl. No.: 150,104

[22] PCT Filed: Mar. 29, 1993

[86] PCT No.: PCT/EP93/00761

§ 371 Date: Jan. 24, 1994

§ 102(e) Date: Jan. 24, 1994

[87] PCT Pub. No.: WO93/19647

PCT Pub. Date: Oct. 14, 1993

[30] Foreign Application Priority Data

Mar. 27, 1992 [DE] Germany ..... 42 10 098.4

[51] Int. Cl.[6] ..... A47C 3/22

[52] U.S. Cl. ..... 297/314; 297/302.4; 297/344.1; 248/372.1

[58] Field of Search ..... 297/302.4, 313, 297/314, 325, 311, 338, 344.1; 248/130, 160, 371, 372.1

[56] References Cited

U.S. PATENT DOCUMENTS

| | | | |
|---|---|---|---|
| 522,387 | 7/1894 | Pederson | 297/314 X |
| 2,132,291 | 10/1938 | Fitos . | |
| 3,309,137 | 3/1967 | Wiebe | 297/302 |
| 4,099,697 | 7/1978 | Von Schuckmann | 297/314 X |
| 4,372,606 | 2/1983 | Faull | 297/313 X |
| 4,871,208 | 10/1989 | Hodgdon | 297/302 X |
| 5,044,587 | 4/1990 | Degen . | |

FOREIGN PATENT DOCUMENTS

| | | | |
|---|---|---|---|
| 921588 | 11/1954 | Germany | 297/314 |
| 1787342 | 4/1959 | Germany . | |
| 1829791 | 4/1961 | Germany . | |
| 1205666 | 11/1965 | Germany . | |
| 7531129 | 10/1975 | Germany . | |
| 2642112 | 3/1978 | Germany . | |
| 71026 | 10/1952 | Netherlands | 297/302 |

*Primary Examiner*—Peter R. Brown

*Attorney, Agent, or Firm*—Birch, Stewart, Kolasch & Birch

[57] ABSTRACT

An active dynamic seat has a base, an intermediate piece linked to the base and a seating part linked to the intermediate piece. The seating part is fixed to the intermediate piece and the intermediate piece is linked to the base by a single bearing in a substantially fixed manner in the vertical direction and in a tilting manner in all lateral directions. The tilting movement is limited in all directions by a stop and one or several restoring devices are provided to restore the unloaded intermediate piece to the vertical.

8 Claims, 8 Drawing Sheets

ACTIVE DYNAMIC SEAT

The invention relates to an active dynamic seat.

BACKGROUND OF THE INVENTION

Conventional seating furniture is designed in most cases so that the body, especially the back, is supported by correspondingly fashioned seating surfaces and backs in an anatomically maximally favorable position. Although such seating furniture is frequently felt to be comfortable, there is the decisive drawback that the body sits merely passively on such seats, i.e. the back muscles are hardly stressed, and the intervertebral disks are stressed merely statically in the "pressure mode". As a result, a long-term usage of such seat furnishings leads to degeneration of the back muscles and wasting of the intervertebral disks. Impairment of health and pains in the back and hip regions (e.g. sciatica) are the frequent consequence of such static and passive sitting.

For this reason, seating furnishings have been developed permitting a so-called active dynamic sitting wherein the back musculature and the intervertebral disks are constantly slightly active. This active dynamic sitting attitude is attained in practically all cases by maintaining the actual seat of the seating furniture in a labile position and making it optionally additionally resilient in the vertical direction.

Such an active dynamic seating device has been described, for example, in DE 73 11 140. This seat consists essentially of a seat part connected via a first tilting joint with a supporting shank, the latter, in turn, being articulated by means of a second tilting joint to the base of the seating device. In this arrangement, each tilting joint consists preferably of a cap formed respectively at the end of the supporting shank, this cap being guided in a hollow cylinder and stressed by a coil spring arranged in the hollow cylinder.

On account of the planar structure of the underside of the cap, the latter is in contact, in the non-stressed condition, with the bottom or, respectively, top of the hollow cylinder so that, without stress, a perfect alignment is achieved of base, supporting shank, and seat. When stress is exerted on this seating device, the two coil springs of the tilting joints are compressed, the two caps being urged into the two hollow cylinders. The tilting movement of these two joints is attained by the feature that the bore in the top of the lower cylinder or, respectively, in the bottom of the upper hollow cylinder is slightly larger than the outer diameter of the supporting shank.

However, the disadvantage arises herein that the maximally possible tilting angle of each tilting joint in the stressed condition is dependent on the distance of the planar side of the cap from the bottom or top of the hollow cylinder and thus on the weight of the person presently using this seating device. Moreover, it is extremely difficult to maintain one's balance on this seating device so that, at least for inexperienced users, there must be the possibility that at least one of the tilting joints is blocked. This results from the fact that, upon deflection of the tilting joint at the base of the seating device into a specific direction, a deflection of the upper tilting joint in the same direction takes place in a preferred manner.

SUMMARY OF THE INVENTION

The invention is based, therefore, on the object of providing an active dynamic seat ensuring, on the one hand, a seating position active to an adequate extent and, on the other hand, permitting a harmless use of the seating device even without a prolonged training phase and/or familiarization phase.

Moreover, the invention is based on the task of creating an active dynamic seat that can be produced in a simple and economical way.

The fixed connection of the seat part of the seating device according to this invention with the intermediate piece and the connection of the intermediate piece with the base, which can be deflected into any direction, ensure, on the one hand, an active dynamic sitting. On the other hand, the use of a single tilting joint in conjunction with a device for restoring the intermediate piece and the seat part into the neutral position ensures that the seating device can be utilized even by practically untrained persons without a long period of familiarization since the equilibrium of the seating device according to this invention is not labile to the great extent as in case of previously known active dynamic seats.

This restoring device can be designed, for example, as a vibration mount serving simultaneously as a tilting joint, or as resilient elements additionally engaging at the intermediate piece.

According to another embodiment of the invention, the intermediate piece can be designed to be vertically resilient to enhance sitting comfort.

In a further embodiment of the invention, the rigid intermediate piece has a plate at its lower end; several bores are provided in the outer region of this plate, Pins retained vertically in or at the base extend through the bores, the diameter of these pins being smaller than the diameter of the bores. Above and below the plate of the intermediate piece, coils springs are arranged on these pins, In this embodiment, the coil springs serve for making the intermediate piece vertically resilient and at the same time provide for the tilting movement of the intermediate piece, The maximum tilting angle is determined herein by the appropriate choice of the diameters of the bores and the outer diameters of the pins and thus is independent of the vertical spring displacement or the weight of the user of the seat.

Additional embodiments of the invention can be derived from the dependent claims.

BRIEF DESCRIPTION OF THE DRAWINGS

The invention will be described in greater detail below with reference to embodiments shown in the drawings wherein.

DETAILED DESCRIPTION OF THE EMBODIMENTS

Figure 1:
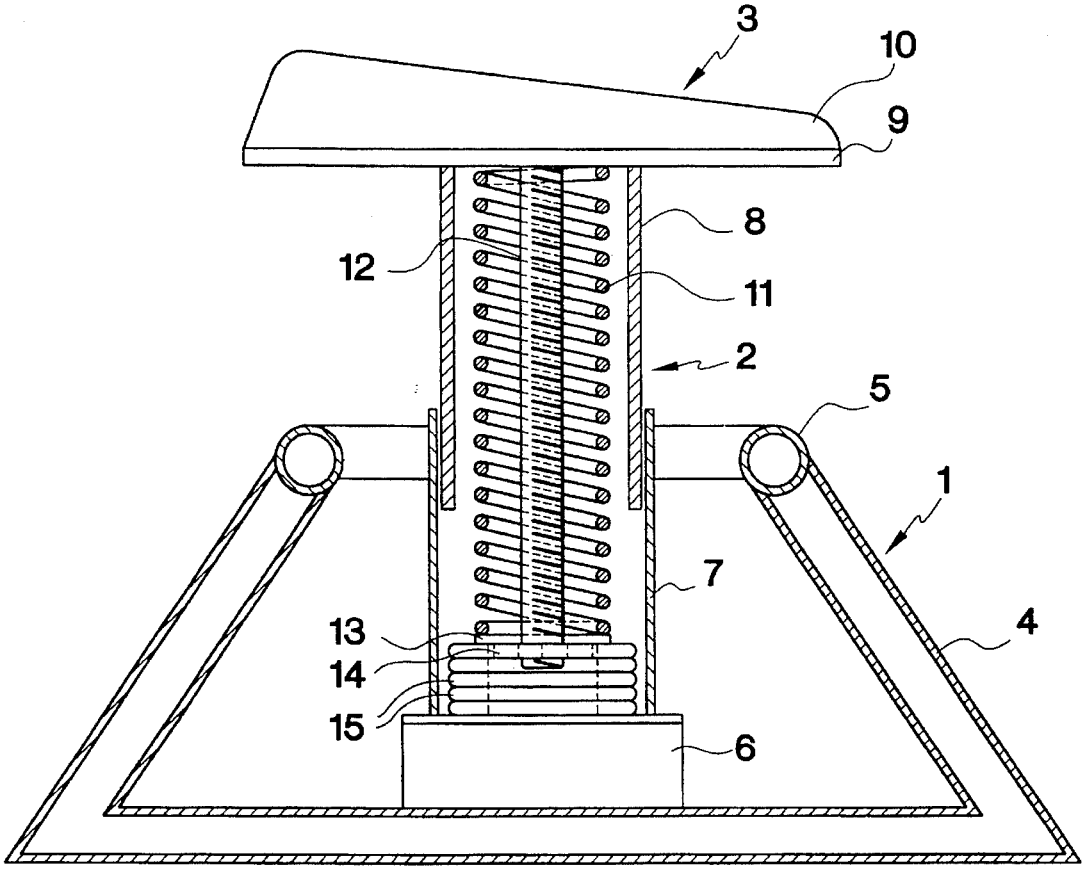
FIG. 1 shows a first embodiment of the seating device according to the invention.

The embodiment of the seating device according to this invention illustrated in FIG. 1 consists of a base 1, an intermediate piece 2, as well as a seat part 3.

The base 1 essentially comprises a base part 4 in the shape of a hollow-cone section or of several feet, preferably five of them. The base part 4 is double-walled and thus is designed to be hollow on the inside. The upper ends of the inner and outer walls of the hollow-cone section are integrally connected with a limiter ring 5.

The intermediate piece 2 is connected with the bottom of the base part 4 by means of an elastically flexible element 6. The elastically flexible element 6 ensures a connection of the intermediate piece 2 with the base 1 that can be tilted into any desired direction and simultaneously effects the resetting of the unstressed intermediate piece into the neutral position; the element is preferably designed as a vibration mount.

The intermediate piece 2 consists of a lower hollow cylinder 7 arranged on the flexible element 6 and fixedly joined thereto as well as of an upper hollow cylinder 8, the outer diameter of which corresponds substantially to the inner diameter of the lower hollow cylinder 7 so that the upper hollow cylinder is guided in the lower hollow cylinder in the vertical direction.

Figure 8:
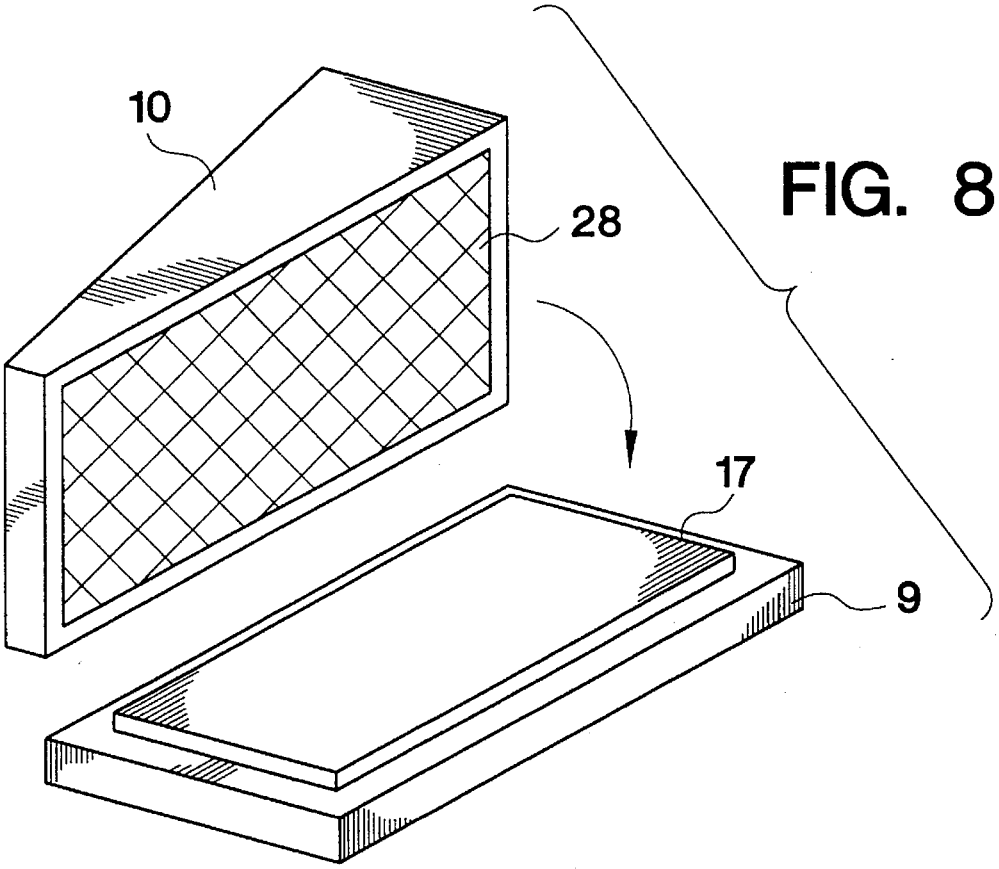
FIG. 8 shows the connection means for selectively connecting a seat cushion to a seat part.

The upper end of the upper hollow cylinder 8 is fixedly connected to a plate 9 of the seat part 3 on which a seat cushion 10 is arranged. The seat cushion 10 can consist, for example, of fabric-covered foam material and can be optionally connected to the plate 9 in a fixed or releasable fashion, as by known conventional selective fixing means 17, shown by a block in FIG. 8. In order to promote an anatomically favorable sitting attitude, the seat cushion 10 can be designed to be convex, concave, planar, or wedge-shaped. In case of a wedge-shaped design, the higher end of the wedge should be located in the back of the seated person.

Figure 9:
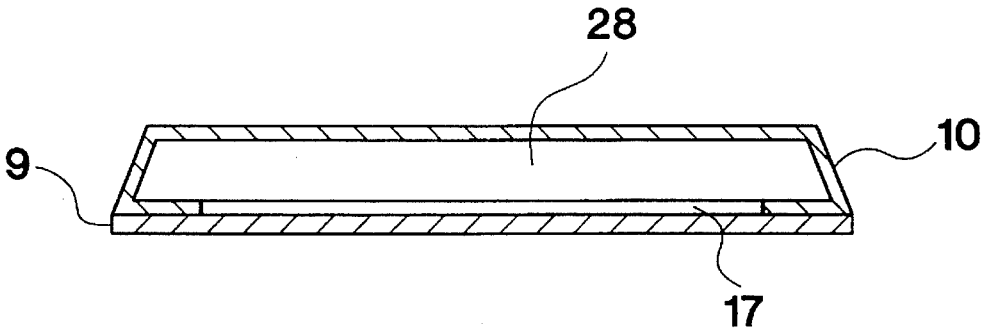
FIG. 9 shows a core structure of the seat cushion.

Furthermore, as shown in FIG. 9, the seat cushion can exhibit a dimensionally stable core structure 18 in a preferred embodiment in order to maintain the shape desired for improving the sitting attitude even under load to a substantial extent.

Within the two hollow cylinders of the intermediate piece 2, a coil spring 11 is arranged which acts with its upper end on the plate 9 of the seat part 3 or on an intermediate bottom located horizontally in the upper hollow cylinder 8; with its lower end, the spring rests on the flexible element 6 or on an intermediate bottom horizintally provided in the lower hollow cylinder 7.

A rod 12 connected to the plate 9 of the seat part 3 extends within the coil spring 11; this rod projects past the lower end of the coil spring and permits pretensioning of the coil spring by means of a shim 13 as well as a nut 14 that can be threaded onto a thread provided at the lower end of the rod 12. In this way, the characteristic of the vertical resiliency of the seat can be adapted to the prevailing requirements.

Moreover, the height of the seat can be varied in a simple way by the insertion of spacer disks 15 between the flexible element 6 and the shim 13.

In order to prevent lift-off of the seat part 3 or the parts of the intermediate piece 2 connected therewith from the remainder of the seating device, the spacer disks 15 can be connected, by means of a retaining device not shown in detail, in a releasable fashion with the flexible element 6 or with the lower hollow cylinder 7.

However, this objective can also be attained, for example, by providing the upper hollow cylinder 8 with at least one slotted hole extending in the vertical direction, a pivot or pin arranged at the lower hollow cylinder 7 engaging into this hole. In this case, the upper and, respectively, lower abutment for the vertical movement of the seat part 3 or of the upper hollow cylinder 8 can be fixedly determined by a corresponding design of the slotted hole as well as by a suitable positioning of the pivot relatively to the slotted hole.

The base 1 can, of course, also assume any other desired shape ensuring the stability of the seat and limiting the maximum tilting angle of the intermediate piece 2 in the aforedescribed way. For example, the base can exhibit several feet arranged in a stellate pattern which are drawn upwards toward the intermediate piece and are connected at their upper end to a frame limiting the tilting movement.

Moreover, several casters can be arranged at the base 1 in a conventional way in order to make it possible to readily shift the seating device.

In another embodiment, the base 1 can exhibit a supporting surface structure that is curved downwardly in a slightly convex fashion, likewise facilitating the displacement of the seating device due to the smaller contact surface. It has furthermore been found that such a very slight curvature of the supporting surface structure—with a diameter of the base of about 50 cm to 60 cm, the marginal zone of the base should have a spacing of about 0.5 cm to 1 cm from a planar contact surface—has a positive effect on the desired sitting attitude.

These above-described optional modifications of the first embodiment according to the invention can, of course, also be combined with the subsequently disclosed additional embodiments of the invention.

Figure 2:
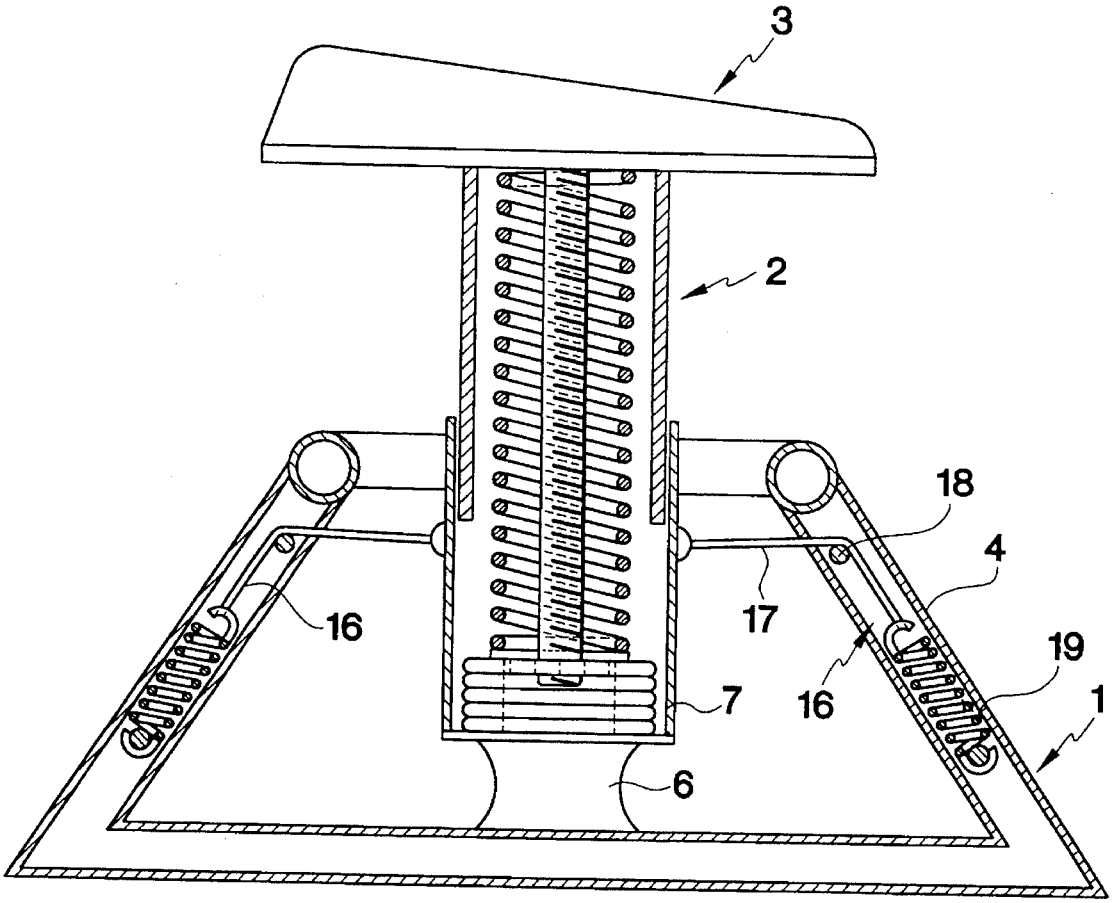
FIG. 2 shows the embodiment of FIG. 1 with an additional restoring device.

FIG. 2 shows a further arrangement of the embodiment of FIG. 1 wherein additional devices 16 are provided for restoring the unstressed intermediate piece 2 or the unstressed seat part 3 into the neutral position. These restoring devices 16 consist herein of flexible tension elements 17 attached to the periphery of the lower hollow cylinder 7, these elements being extended through corresponding openings in the inner wall of the base part 4 into the interior of the base part. In the interior of the base part, the tension elements are deflected by means of deflection elements 18 designed, for example, as rollers, in such a way that they extend substantially in parallel to the inner or outer wall of the base part. The ends of the tension elements 17 are connected to coil springs 19 which are each arranged likewise in the interior of the base part 4. The coil springs 19 are preferably also pretensioned in the neutral position of the intermediate piece 2.

The restoring devices 16 can, of course, also be designed in some other way and need not be arranged in the interior of the base part 4.

On account of the use of such restoring devices 16 engaging at the intermediate piece 2, it is possible to connect the intermediate piece 2 to the base 1 by means of any desired bearing admitting a tilting motion in any desired direction, instead of the elastically flexible element 6 which upon deflection simultaneously produces a restoring moment.

Figure 3:
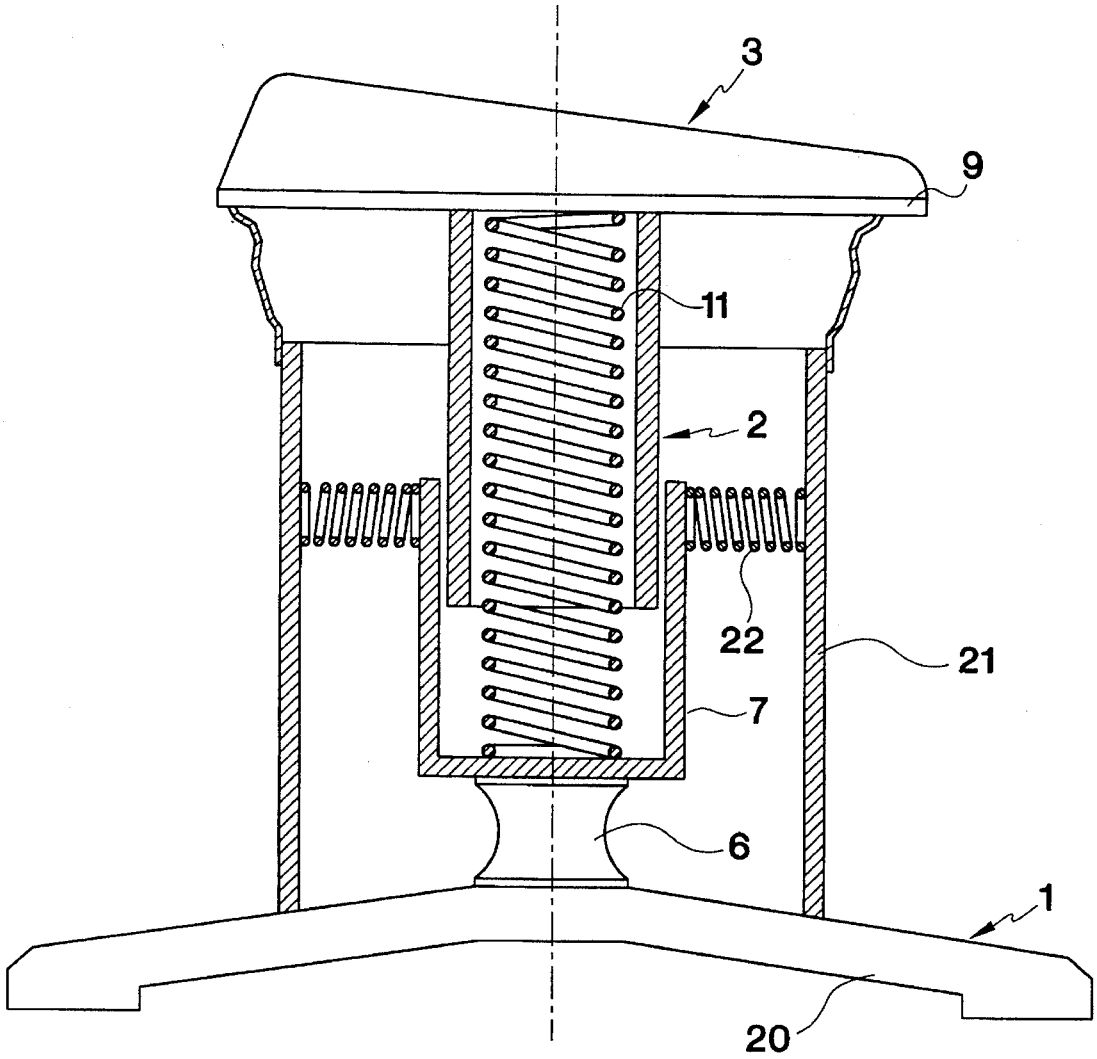
FIG. 3 shows a second embodiment of the seating device according to the invention.

The embodiment of the invention illustrated in FIG. 3 corresponds in its function essentially to the embodiment according to FIG. 1.

The decisive difference resides in the use of a base 1 having a different structure. This base consists of a base part 20 exhibiting several—preferably five—feet to ensure the stability of the seating device, as well as of an outer hollow cylinder 21 surrounding the intermediate piece 2. The intermediate piece 2 and the seat part 3 are identical to the corresponding components of the aforedescribed embodiments.

Several devices for restoring the intermediate piece or the seat part to the neutral position, preferably designed as coil springs 22, engage preferably in equidistant spacings distributed at a certain level over the periphery of the lower hollow cylinder 7 of the intermediate piece 2. The coil springs 22 are arranged in the radial direction between the lower hollow cylinder 7 and the outer hollow cylinder 21 of the base part 20 and are connected thereto by means of retaining or mounting devices not shown in detail.

The coil springs 22 can act as tension or compression springs and ensure, with an appropriate choice of the spring constant, on the one hand, the resetting of the unstressed intermediate piece or seat part into the neutral position.

At the same time, the tilting motion of the intermediate piece is restricted by the coil springs 22 to a maximally permissible angle.

On the other hand, the characteristic of the labile equilibrium of the seat part 3 and thus the characteristic of the active dynamic seat position is also determined by the dimensioning of the coil springs 22 and optionally by the dimensioning of the flexible element 6, i.e. by the dimensioning of the restoring devices.

Restoring can take place, instead of with the aid of the coil springs 22, also by a rubber diaphragm designed as a circular ring, connecting the outer hollow cylinder 21 and the lower hollow cylinder 7.

Figure 4:
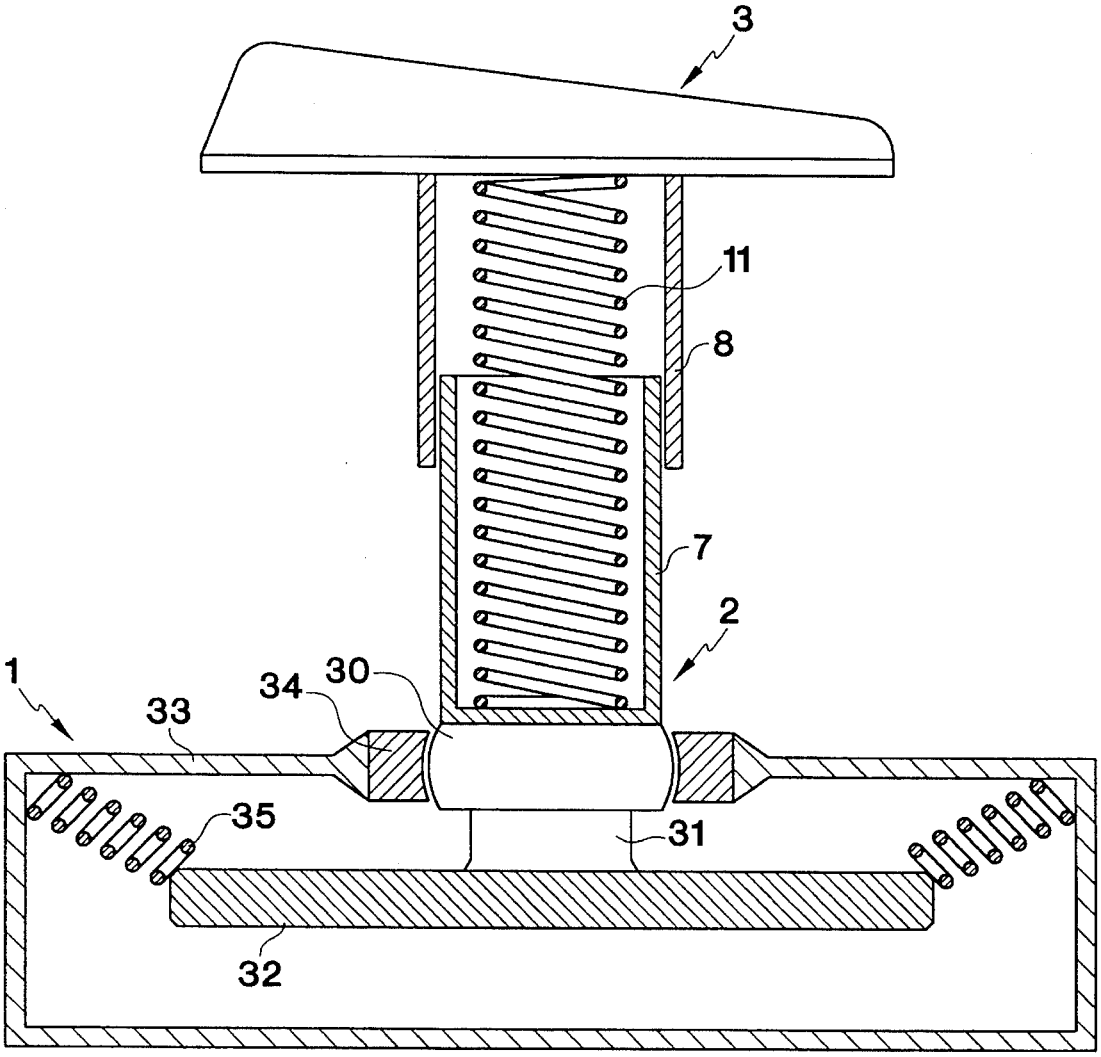
FIG. 4 shows a third embodiment of the seating device according to the invention.
Figure 5:
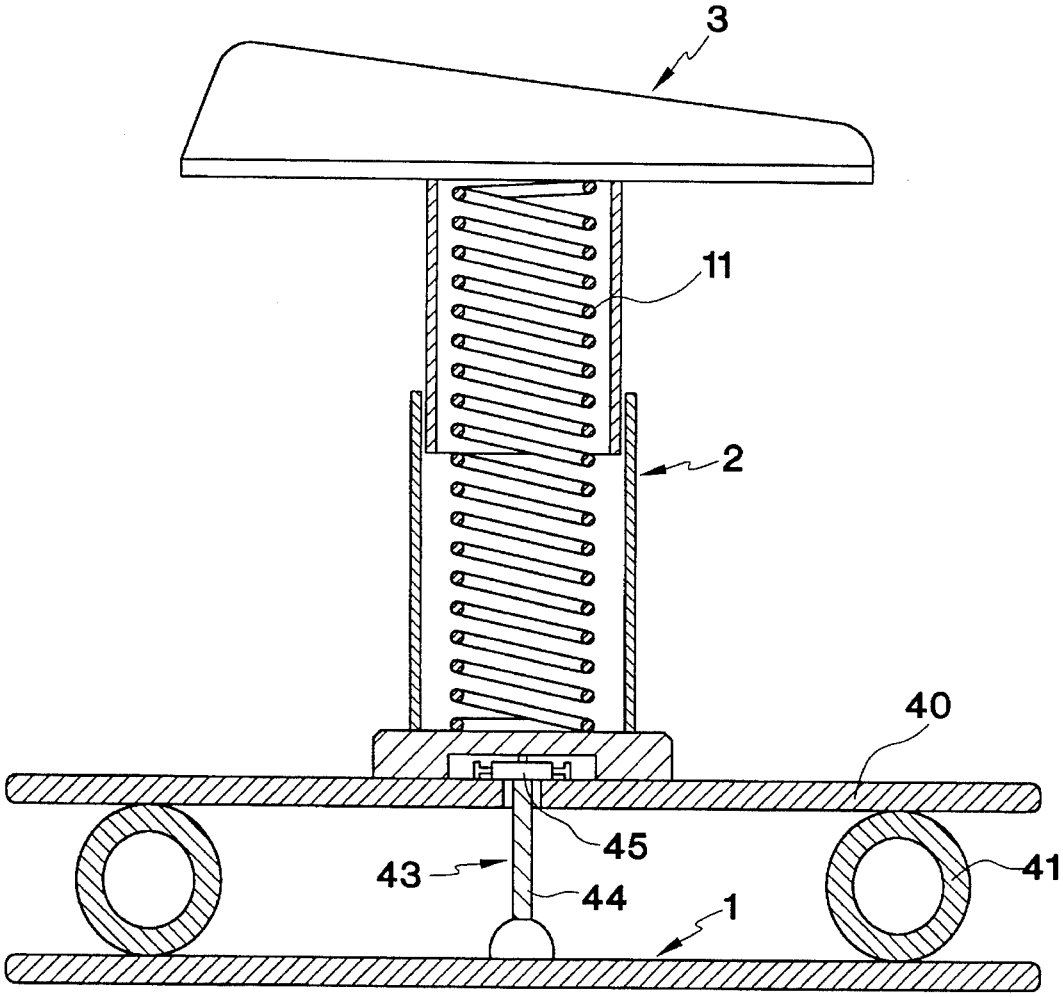
FIG. 5 shows a fourth embodiment of the seating device according to the invention.

Although, in the embodiments of the invention shown in FIGS. 3, 4 and 5, a device according to FIG. 1 for pretensioning the coil spring 11 of the intermediate piece 2 has been eliminated, such a device can, of course, also be utilized in conjunction with these embodiments. In order to prevent lift-off of the seat part 3 from the remainder of the seating device, the upper or lower end of the coil spring 11 can be connected in a simple way with the plate 9 of the seat part 3 or with the bottom of the lower hollow cylinder 7 by means of mounting devices that are not shown in detail.

In order to avoid contamination of the interior of the seating device, it is moreover possible to cover the interspace between the upper rim of the outer hollow cylinder 21 and the plate 9 of the seat part 3 by means of a flexible and/or elastic cuff, for example a folding bellows or a rubber sleeve. This eliminates at the same time the danger of pinching one's fingers between the top edge of the outer hollow cylinder 21 and the underside of the plate 9.

The embodiment of the invention illustrated in FIG. 4 comprises an intermediate piece 2, the upper zone of which is substantially identical to the intermediate pieces of the aforedescribed embodiments. Since this zone formed by the two hollow cylinders of the upper intermediate piece neither is engaged by restoring devices nor includes a stop, the lower hollow cylinder 7 can also be guided within the upper hollow cylinder 8.

In its lower region adjoining the lower hollow cylinder 7, the intermediate piece 2 has a bearing part 30 having the shape of a truncated sphere, i.e. the form of a sphere cut off at the top and bottom in horizontal planes. The diameter of the sphere is preferably chosen to be larger than the outer diameter of the lower hollow cylinder 7.

At its underside, the bearing part 30 is connected to a cylindrical part 31, a preferably circular plate 32 being arranged on the underside of the latter.

The base 1 is designed as a cylindrical hollow member having a central opening in its upper wall wherein the bearing part 30 of the intermediate piece 2 is supported by means of a bearing ring 34 of a suitable design. The ball bearing formed in this way and consisting of a single ball accordingly permits tilting of the intermediate piece 2 or the seat part 3 into any desired direction.

Of course, in place of the aforedescribed ball bearing, any other bearing can also be utilized in this embodiment as long as it permits a tilting movement of the intermediate piece, for example the dual-gimbal suspension of the intermediate piece in the upper wall of the base.

For restoring the unstressed intermediate piece 2 into the neutral position, several restoring devices 35, preferably designed as coil springs, engage at the plate 32 of the intermediate piece 2 located in the interior of the base 1. These coil springs preferably extend in the radial tilting direction of the circular plate 32. In addition to their restoring function, the dimensioning of the coil springs 35 determines, as mentioned above, the characteristic of the labile equilibrium of the seating device and thus the characteristic of the active dynamic sitting position.

However, restoration can also be brought about, for example, by a circular-ring-shaped rubber diaphragm joining the circular plate 32 and the cyindrical hollow member 7 of the base 1.

The lateral limitation of the tilting motion of the intermediate piece 2 can take place in this embodiment in several different ways: For example, the height of the cylindrical part 31 and the diameter of the circular plate 32 can be chosen so that, upon the maximum deflection of the tilting motion, the marginal zone of the circular plate 32 is in contact with the underside of the upper wall 33 of the base 1. A further possibility resides in that the maximum deflection of the tilting motion is limited by the contacting of the lower rim of the lower hollow cylinder 7 against the upper rim of the bearing ring 34, by a suitable choice of the diameter of the bearing part 30 and the diameter of the lower hollow cylinder 7, as well as by a suitable design of the bearing ring 34.

In the embodiment of the invention shown in FIG. 5, the intermediate piece 2 is mounted on a preferably circular plate 40.

The base 1 consists in this embodiment merely of a preferably circular plate 42 which, in the preferred embodiment, has the same diameter as the circular plate 40.

The intermediate piece 2 is supported with its circular plate 40 on an annular, elastically compressible element 41 arranged on the circular plate 42. This element 41 can be fashioned, for example, as an air- or liquid-filled rubber hose, or it can be made of foam rubber or a similar material.

In order to prevent lift-off of the top section of the seating device from the circular plate 42 and the elastically compressible element 41 and optionally to permit pretensioning of the elastically compressible element 41, a tensioning device 43 is provided. The tensioning device 43 consists of a flexible element 44 centrally mounted on the surface of the circular plate 42, this element projecting through a central bore in the circular plate 40 and being mounted on the topside of the circular plate 40 by means of a mounting device 45. In this arrangement, the mounting device 45 can simultaneously permit the infinitely variable setting of the pretensioning of the elastically compressible element 41.

Of course, in place of a single, centrally arranged mounting device 45, it is also possible to provide several tensioning devices distributed, for example, over the periphery of the circular plate 40 or 42.

The stop for the lateral tilting motion of the intermediate piece 2 is determined in this embodiment of the invention by the maximum compressibility of the elastic element 41.

Figure 6:
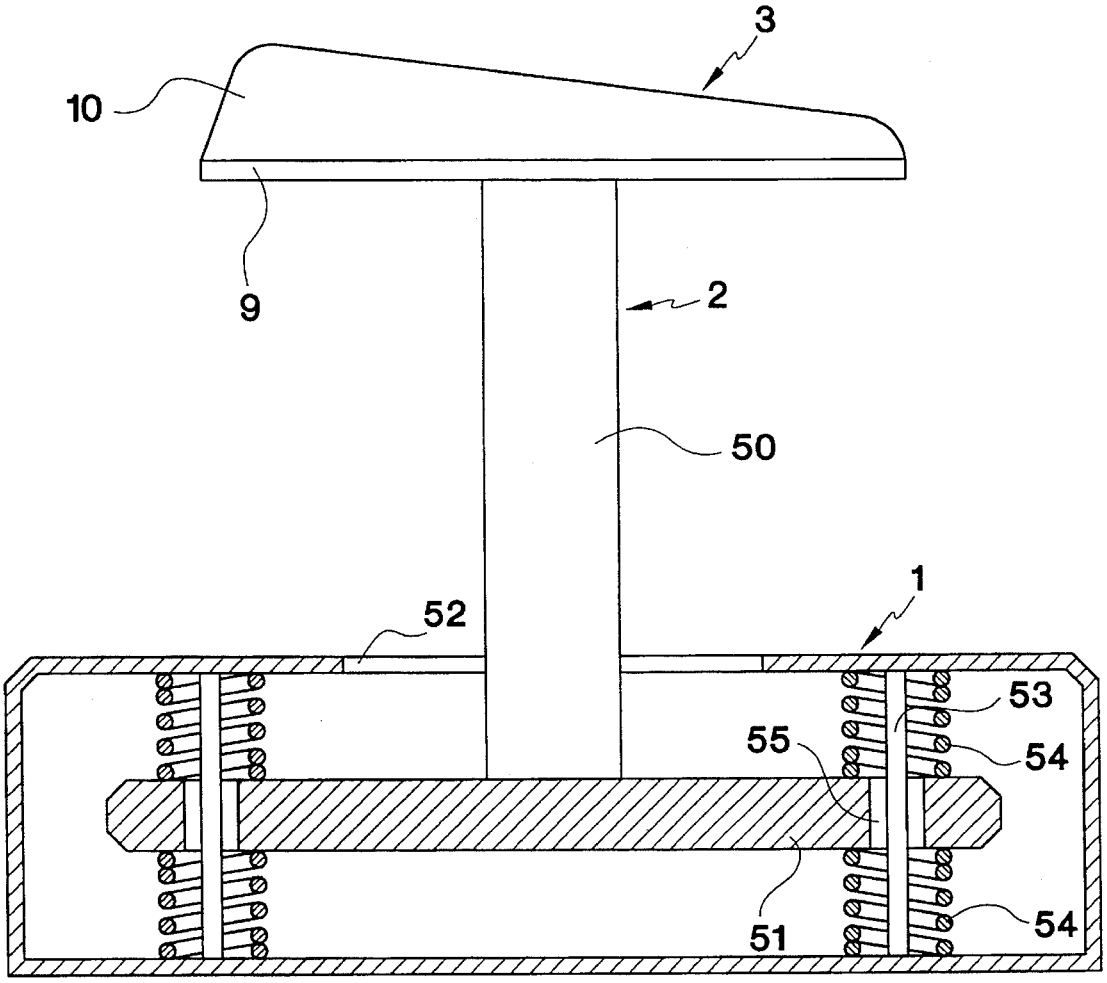
FIG. 6 shows a fifth embodiment of the seating device according to the invention.

In contrast to the aforedescribed embodiments of the invention, the embodiment illustrated in FIG. 6 exhibits a rigid intermediate piece 2 made up of a cylindrical section 50 and a preferably circular plate 51 arranged at the lower end of this section.

The base 1 is designed as a cylindrical hollow body, a central opening 52 being provided in the upper wall thereof; the diameter of this opening is chosen to be larger than the outer diameter of the cylindrical section 50. The circular plate 51 of the intermediate piece 2 arranged in the interior of the base 1 exhibits at its outer rim several vertically extending bores 55 preferably located at equidistant spacings. Vertically arranged, preferably cylindrical pins 53 extend in the bores 55 and are connected with their ends in each case to the upper or, respectively, lower wall of the base 1. The outer diameter of the pins 53 is chosen to be smaller by a certain amount than the inner diameter of the bores 55 in the circular plate 51 in order to permit a tilting motion of the intermediate piece 2.

For a resilient mounting of the intermediate piece 2 in the vertical direction and simultaneously for ensuring a resetting of the unstressed intermediate piece into the neutral position, the circular plate 51 is supported on coil springs 54 within which the pins 53 extend. For providing an adequate vertical play for the outer zones of the circular plate 51 during the tilting of the intermediate piece 2, coil springs 54 are liekwise arranged between the upper wall of the base 1 and the topside of the circular plate 51.

The characteristic of the labile equilibrium of the seating device is determined by a corresponding dimensioning of the coil springs 54, the coil springs 54 being optionally pretensioned. If needed, the upper and lower coil springs 54 can be located to be offset radially with respect to each other for this purpose.

The limitation of the lateral tilting motion of the intermediate piece 2 is provided in this embodiment preferably by the feature that the diameter of the bores of the circular plate 51 is adapted to the diameter of the rods 53 extending therein so that a maximally permissible tilting angle is not exceeded. As a result, the maximum tilting angle becomes independent of the load on the seat and/or of the weight of the user.

Also in this embodiment, the base 1 and the plate 51 need not necessarily be designed of a circular shape. Rather, both parts can be fashioned in a stellate configuration, as is conventional, wherein the aforementioned resilient bearings are correspondingly located in several arms of the star, or in all arms thereof.

Figure 7:
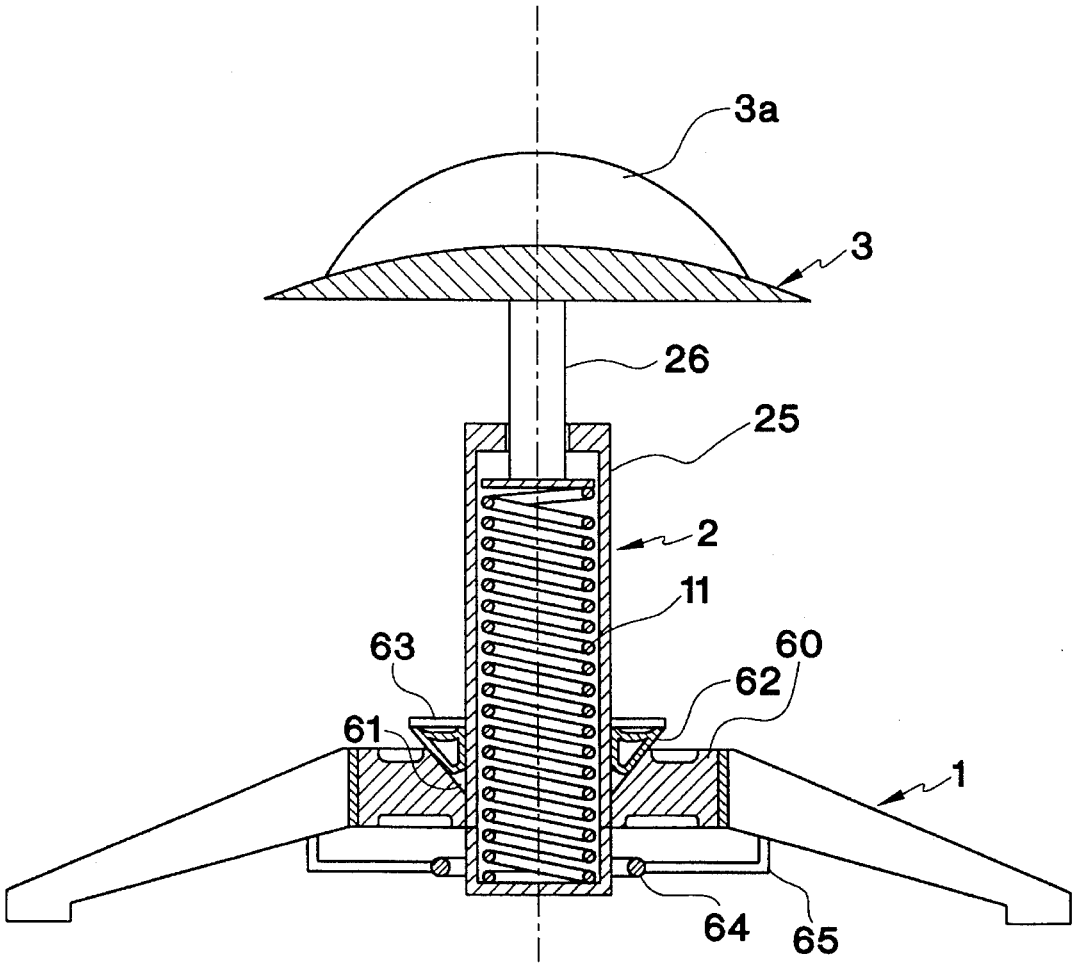
FIG. 7 shows a sixth embodiment of the seating device according to the invention.

Finally, FIG. 7 shows an embodiment of the invention, the properties of which ensue approximately from a combination of the embodiments according to FIGS. 1 and 4. For this reason, the following description will be limited to the principle underlying this embodiment.

As shown in FIG. 7, the intermediate piece 2 is retained by means of a rubber diaphragm 60 of an annular shape in a central, preferably circular opening of the base 1. The intermediate piece 2 is composed of a combination of two telescoping pieces, an outer piece 25 and an inner piece 26 as well as a supporting element ring. Inner piece 26 is rigidly connected to the underside of seat 3 while outer piece 25 is disposed within rubber diaphragm 60. Coil spring 11 is arranged inside outer piece 25 and acts on the lower end of inner piece 26 to support the seat 3. In FIG. 7, the base 1 is shown with a plurality of downwardly and outwardly extending legs for supporting the seat. The rubber diaphragm 60 can here be considered to be an annular vibration mount with a suitable spring characteristic, retaining the intermediate piece 2 substantially rigidly in the vertical direction and tiltable into any desired lateral direction in the base 1. At the same time, the rubber diaphragm 60 takes over the function of a device for restoring the unstressed intermediate piece or the seat part into the neutral (vertical) position.

For setting the characteristic of the restoring forces, the rubber diaphragm 60 exhibits an annular bevel or chamfer 61 on the surface adjoining the intermediate piece 2 so that an annular groove is created adjacent to the intermediate piece.

A ring 62 pushed onto or threaded onto the intermediate piece 2 engages into this groove with a conical outer surface. Depending on the vertical position of the ring 62, adjustable by further tightening or loosening or by means of other suitable devices (e.g. by means of a nut 63 arranged above the ring 62 and threaded onto the intermediate piece), the ring 62 compresses the rubber diaphragm 60 to varying extents (in the vertical as well as horizontal directions) so that in this way the desired hardness of the spring action of the diaphragm can be adjusted.

Limitation of the lateral tilting movement of the intermediate piece is effected, for example, by a limiter ring 64 arranged underneath the diaphragm 60 at the base 1, this ring being joined to the base by means of several arms 65.

Additionally, the seat part 3 of this embodiment comprises a back 3*a*, but this back has merely such a low height that, although an improvement in the sitting comfort is obtained, the active dynamic sitting position is not impaired.

I claim:

1. An active dynamic seat comprising a base, the base including a stop element and a restoring element, each of said restoring element and said stop element being disposed in a central portion of the base, said restoring element having an annular shape and an upper face annular groove, an intermediate piece including a first portion, a second portion and a spring element disposed within the second portion, the first portion being supported by said spring element to telescope the first portion outward from inside the second portion, said intermediate piece being connected to the base by a support element, said support element extending about an outer portion of the second portion for interfacing with said upper face annular groove, and a seat part connected to the intermediate piece, characterized in that the seat part is rigidly connected to the first portion of the intermediate piece to be supported by the spring element, that the second portion of the intermediate piece is supportably connected to the base by means of the support element to be substantially rigid in the vertical direction and to be tiltable into any desired lateral direction, that the tilting motion of the intermediate piece is limited by the stop element, and that the restoring element is provided for resetting the unstressed intermediate piece into the vertical.

2. The seat according to claim 1, characterized in that the support element interfaces with the restoring element.

3. The seat according to claim 2, characterized in that the restoring element is a vibration mount in the form of a rubber diaphragm.

4. The seat according to claim 3, characterized in that the vibration mount is an annular vibration mount, said annular vibration mount retaining the intermediate piece in an opening of the base.

5. The seat according to claim 1 characterized in that the first portion is fashioned to be resilient in the vertical direction.

6. The seat according to claim 1, characterized in that the seat part includes a seat cushion fixedly or releasably connected therewith, the cushion having a shape selected from the group-consisting of planar, convex, concave, or tapered wedge.

7. The seat according to claim 6, characterized in that the seat cushion has a core which is substantially dimensionally stable even under load.

8. The seat according to claim 1, characterized in that the base has a plurality of downwardly and outwardly extending legs for supporting the seat.

* * * * *